United States Patent [19]

Lines

[11] Patent Number: 4,951,811

[45] Date of Patent: Aug. 28, 1990

[54] COMBINED EYE GLASS, CONTACT LENS AND ACCESSORIES CASE

[76] Inventor: Dale O. Lines, 921 3rd Ave., S., Great Falls, Mont. 59405

[21] Appl. No.: 414,540

[22] Filed: Sep. 29, 1989

Related U.S. Application Data

[63] Continuation of Ser. No. 220,667, Jul. 18, 1988, abandoned.

[51] Int. Cl.[5] ..... A45C 11/04

[52] U.S. Cl. ..... 206/5; 150/117; 150/143; 206/5.1

[58] Field of Search ..... 206/5 R, 5.1, 6, 37, 206/38, 233–235; 150/117, 131, 144, 147, 148, 143, 112

[56] References Cited

U.S. PATENT DOCUMENTS

| | | | |
|---|---|---|---|
| 741,339 | 5/1903 | Hille | 150/143 X |
| 814,705 | 3/1906 | Hawes* | 150/143 X |
| 1,025,372 | 5/1912 | Conrad | 206/5 R |
| 1,129,485 | 2/1915 | Harman | 150/131 |
| 1,185,723 | 6/1916 | Schever | 15/143 |
| 1,561,343 | 11/1925 | Michaels | 150/143 X |
| 2,104,439 | 1/1938 | Schein | 206/37 X |
| 2,479,472 | 8/1949 | Coplon | 206/5 R |
| 2,932,383 | 4/1960 | Fagan | 206/5 R |
| 3,124,240 | 3/1964 | Croan | 206/5 R |
| 3,963,102 | 6/1976 | Carp | 150/112 X |
| 4,192,365 | 3/1980 | Siegel | 150/117 X |
| 4,566,130 | 1/1986 | Coates | 150/106 X |

FOREIGN PATENT DOCUMENTS

| | | | |
|---|---|---|---|
| 0078777 | 4/1894 | Fed. Rep. of Germany | 150/131 |
| 2824919 | 9/1979 | Fed. Rep. of Germany . | |
| 0011988 | of 1904 | United Kingdom | 150/131 |
| 0133276 | 10/1919 | United Kingdom | 150/131 |
| 0306696 | 2/1929 | United Kingdom | 150/131 |

*Primary Examiner*—Bryon P. Gehman

*Attorney, Agent, or Firm*—Zarley, McKee, Thomte, Voorhees & Sease

[57] ABSTRACT

A combined eye glass, contact lens and contact lens accessories case comprising a foldable member which may be moved between open and closed positions and which has compartments formed therein to enable eye glasses to be stored therein as well as a contact lens case, a cleaning solution bottle and a wetting solution bottle. A mirror is also provided on the interior of the case.

2 Claims, 4 Drawing Sheets

COMBINED EYE GLASS, CONTACT LENS AND ACCESSORIES CASE

This is a continuation of copening application Ser. No. 220,667 filed on July 18, 1988, now abandoned.

BACKGROUND OF THE INVENTION

Persons who wear contact lenses frequently interchange the same with regular eye glasses. Heretofore, such a person was required to carry a case for the eye glasses, and some means of carrying the contact lens case, wetting solution and cleaning solution To the best of applicant's knowledge, no one heretofore has provided a single case which can accommodate eye glasses, contact lenses, wetting solution and cleaning solution.

It is therefore a principal object of the invention to provide a combined eye glass, contact lens and accessories case.

A further object of the invention is to provide a single case which enables a person to store their eye glasses, and contact lens accessories during the times that contact lenses are being worn and will also enable a person to store their contact lenses, and accessories therefor, when regular eye glasses are being worn.

A further object of the invention is to provide a combined eye glass, contact lens and accessories case which is also provided with a mirror.

Still another object of the invention is to provide a combined eye glass, contact lens and accessories case which is not bulky.

Yet another object of the invention is to provide a combined eye glass, contact lens and accessories case which is convenient to use, durable and refined in appearance.

These and other objects will be apparent to those skilled in the art.

Figure 8:
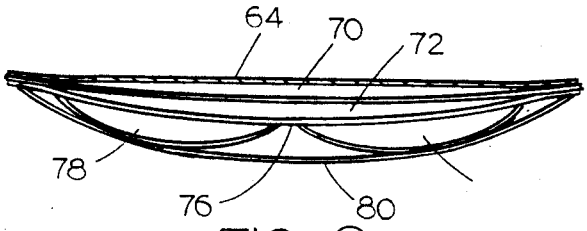
FIG. 8 is a top view of the modified form of the invention in an open position.
Figure 9:
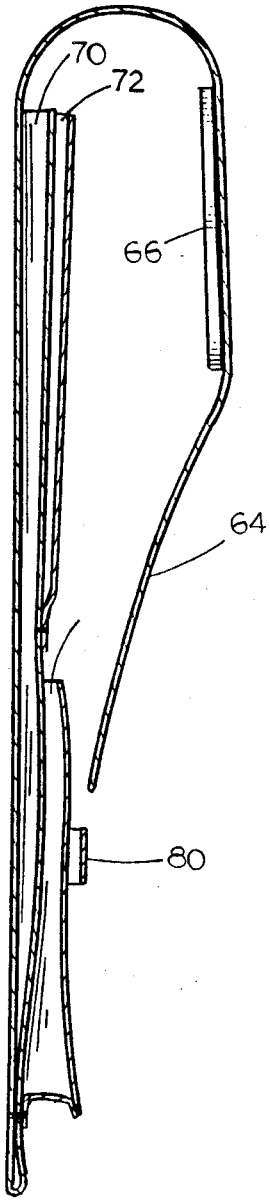
FIG. 9 is a side view illustrating the modified form of the invention being moved to its closed position.

The modified form of the invention illustrated in FIGS. 8–9 is referred to generally by the reference numeral 60 and includes a body portion 62 and a flap portion 64. Mirror 66 is secured to the inside surface of flap portion 64 by gluing or the like. The case 60 is provided with a partition 68 which is secured thereto by stitching or the like so as to have an open upper end and a closed lower end thereby defining an eye glass compartment 70 therebehind. A partition or panel portion

Figure 6:
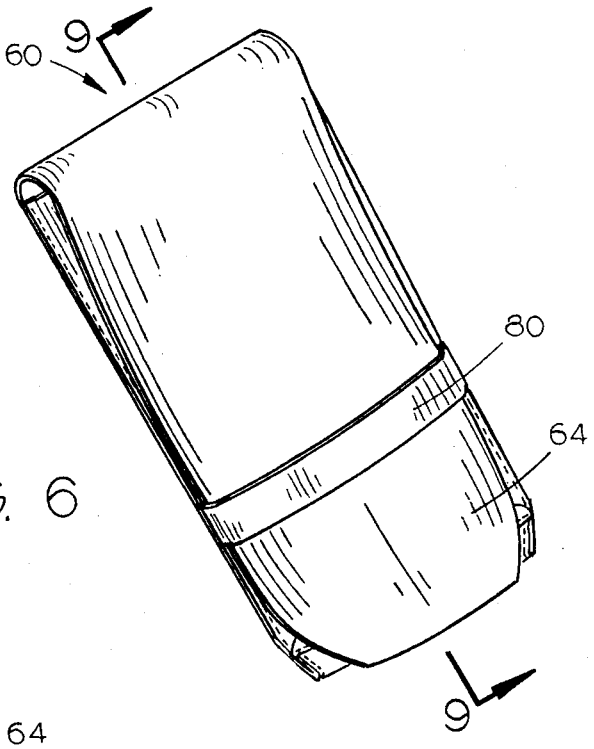
FIG. 6 is a perspective view of a modified form of the invention in a closed position.
Figure 7:
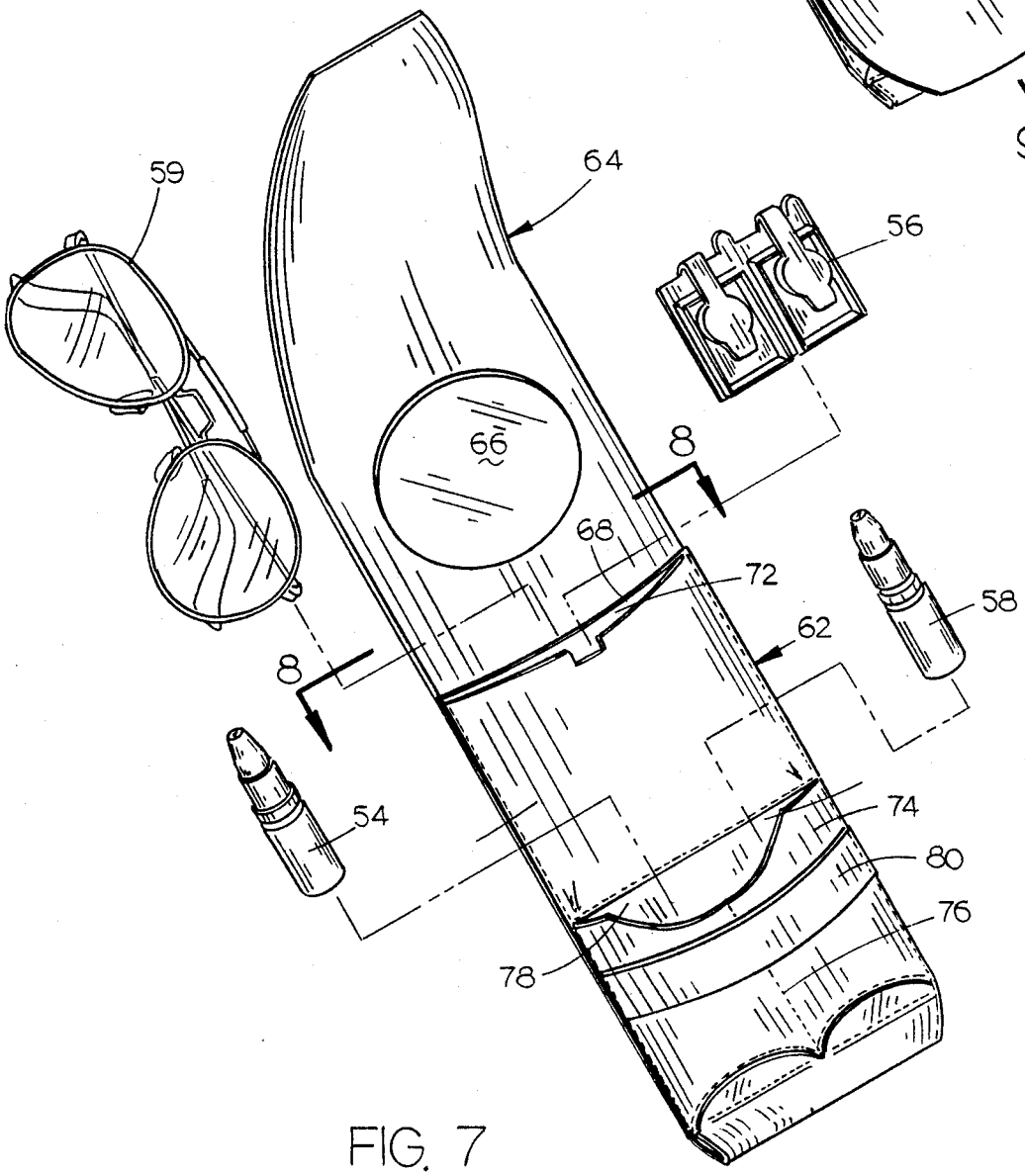
FIG. 7 is a perspective view of the modified form of the invention in an open position.

70 is provided forwardly of partition 68 and is secured to the device so as to have a closed lower end and an open upper end thereby defining compartment 72 adapted to receive contact lens case 56. Panel 74 is provided below panel 70 and is stitched at its center 76 to define compartments 78 and 80 adapted to receive bottles 54 and 58 respectively. Strap 80 is secured at its ends to the sides of the device and is adapted to receive the flap portion 64 therebehind as illustrated in FIG. 6 to maintain the device in a closed condition. The device 60 may be used in the same manner as the device previously described to enable a person to store their eye glasses and the contact lens accessories when contact lenses are being worn and to enable the contact lenses and accessories therefor to be stored when eye glasses are being worn.

SUMMARY OF THE INVENTION

A combined eye glass, contact lens and accessories case is provided comprising a flexible, outer panel member which may be folded upon its self so as to occupy a minimum of space when in the folded condition. A pocket is provided on the inner surface of the panel member for seating eye glasses at times. Also provided at the inner surface of the panel member are storage compartments for wetting solution, cleaning solution and contact lens case. A mirror is also provided on the inside surface of the panel member. Velcro strips are provided to maintain the case in its folded condition at times. A modified form of the invention is also disclosed.

BRIEF DESCRIPTION OF THE DRAWINGS

The preferred case of this invention is illustrated in FIGS. 1–5 and referred to generally by the reference numeral 10 and includes flexible outer panel member 12 having an upper end 14, a lower end 16 and opposite side edges 18 and 20. Fabric material 22 is positioned adjacent the inside surface of panel member 12 and is secured thereto by binding 24 extending around the edges thereof. Binding 24 is secured to the panel member 12 by stitching or the like.

A pair of Velcro strips 26 and 28 positioned adjacent the inside surface of the fabric material 22 and are secured to the fabric material 22 and panel member 12 by stitching or the like adjacent the upper ends thereof as seen in the drawings.

Figure 1:
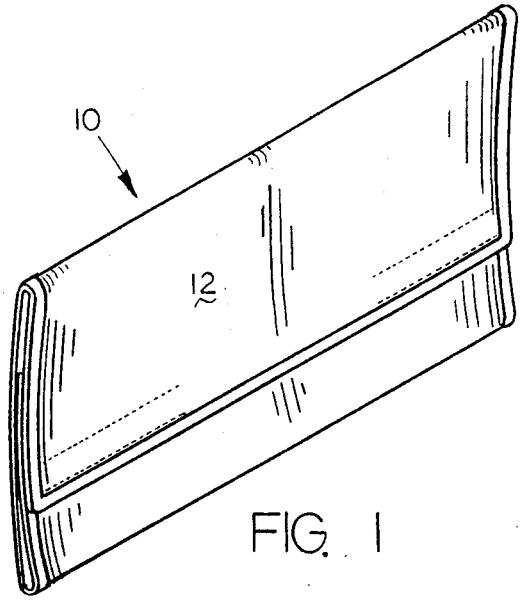
FIG. 1 is a perspective view of the invention in a closed position.
Figure 2:
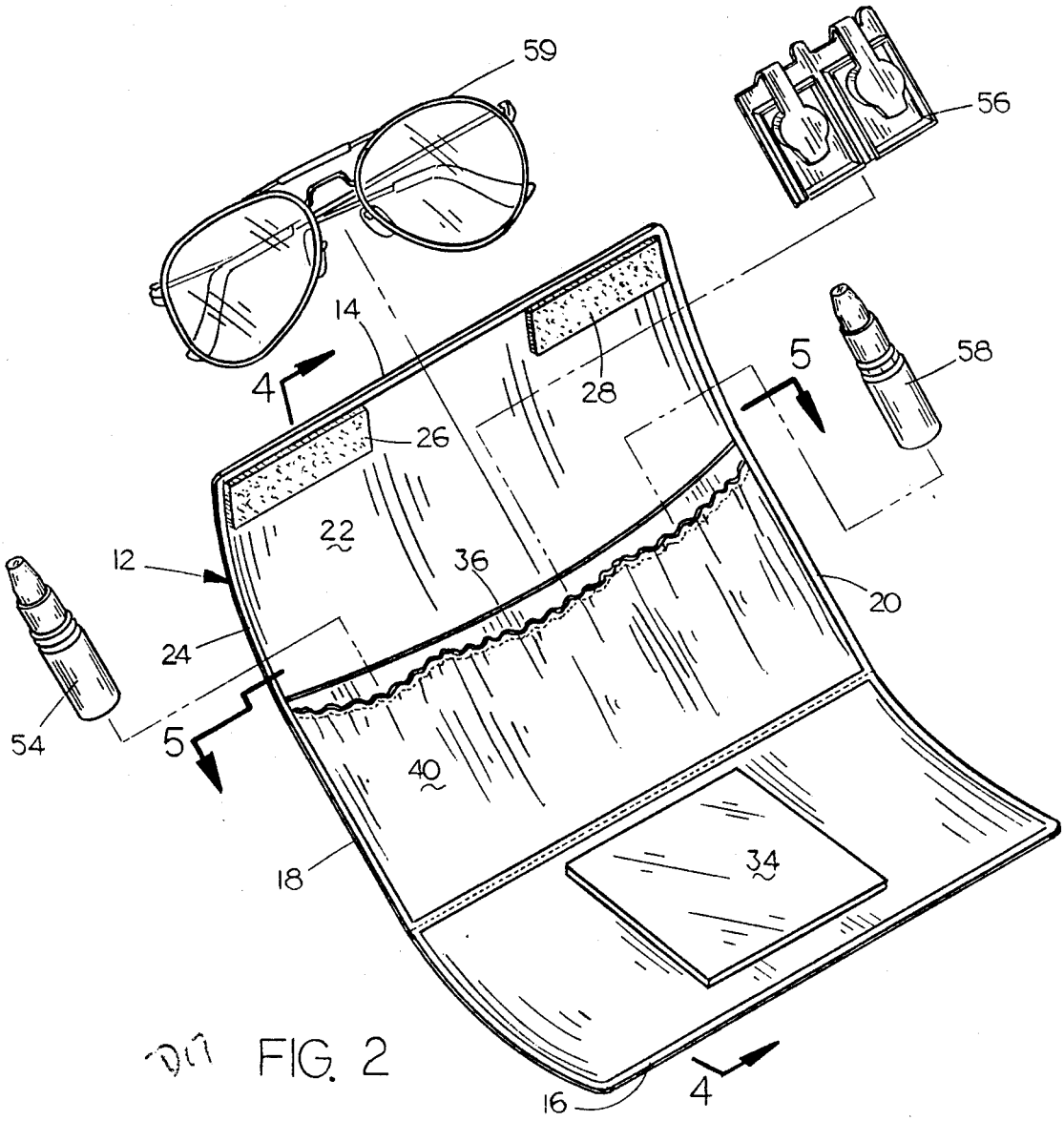
FIG. 2 is a perspective view of the invention in an open position and illustrating the manner in which the eye glasses, contact lens case, and accessories may be inserted thereinto.
Figure 3:
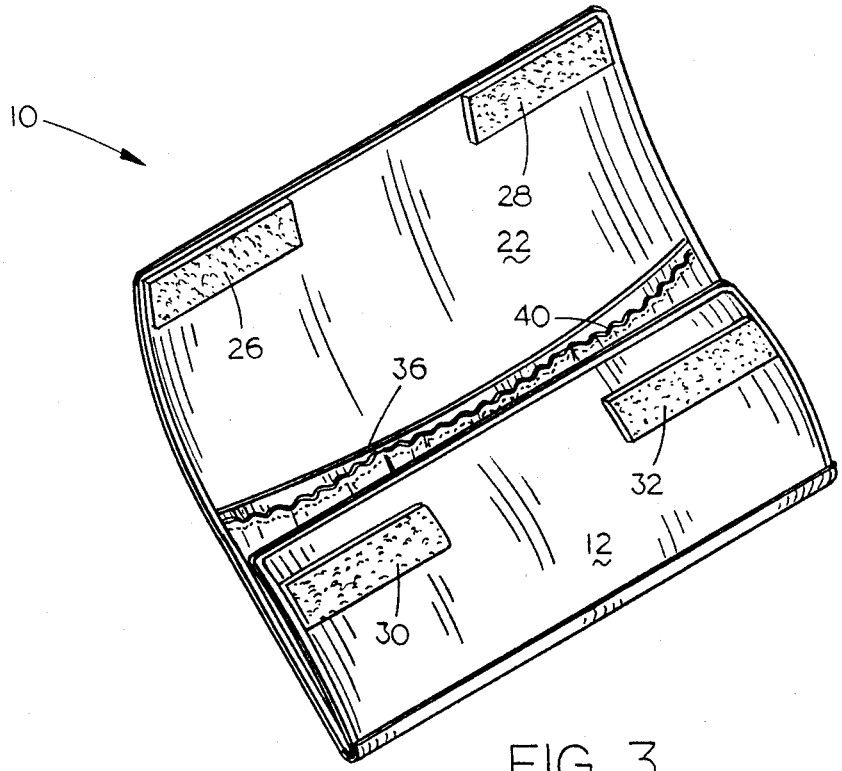
FIG. 3 is a perspective view of the invention in a partially open position.
Figure 4:
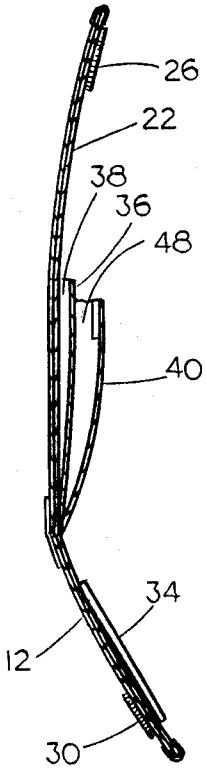
FIG. 4 is a side view of the invention in an open position.

Velcro strips 30 and 32 are secured to the outer surface of panel member 12 adjacent lower end 16 by stitching or the like and are adapted to be detachably connected to the strips 26 and 28 to maintain the case in its folded condition as illustrated in FIG. 1. Mirror 34 is glued to the fabric material 22 adjacent lower end 16 as seen in FIG. 2.

Partition 36 is positioned at the center of fabric material 22 and is secured at its edges to the edges of panel member 12 and fabric member 22 by the same stitching which secures binding 24. The lower horizontal edge of partition 36 is secured to panel member 12 and fabric member 22 by stitching thereby creating an eye glass pocket or compartment 38 having an open upper end.

Figure 5:
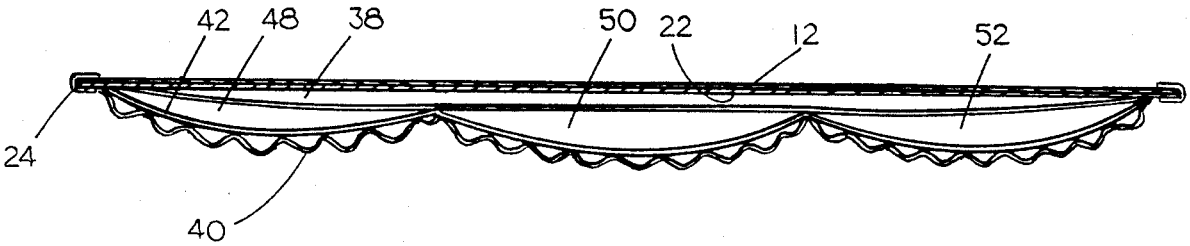
FIG. 5 is an enlarged sectional view seen on lines 5—5 of FIG. 2.

Fabric material 40 is positioned adjacent partition 36 as seen in the drawings and has its side edges secured to fabric material 22 and panel member 12 by stitching and its lower end secured to panel member 12 and fabric material 22 by stitching. A strip 42 of elastic material is secured to the upper inner edge of fabric material 40 as seen in FIG. 5. Strip 42 is secured to partition 36 at 44 and 46 to create gusset-like compartments 48, 50 and 52 suitable for storing contact lens wetting solution bottle 54, contact lens case 56 and cleaning solution bottle 58 therein respectively.

When a person is wearing contact lenses and has no need for eye glasses 59, the eye glasses 59 will be stored in pocket or compartment 38. Wetting solution bottle 54, the empty contact lens case 56 and cleaning solution bottle 58 will be removably stored in the compartments 48, 50 and 52. The case may be folded upon its self as illustrated in FIG. 1 with the Velcro strips 26–30 and 28–32 being connected to maintain the case in its folded condition.

When it is desired to substitute eye glasses for contact lenses, the case may be opened and the mirror utilized to remove the contact lenses from the wearer's eyes. Contact lenses are then inserted into the lens case 56 and inserted into the compartment 50. The eye glasses 59 can be removed from the compartment 38 and worn.

It can therefore be seen that a very novel combined eye glass, contact lens and accessory case is provided which permits a person to carry all of the needed eye glasses, contact lens, wetting solution and cleaning solution in one case. The same being stored therein in a convenient fashion.

Thus it can be seen that the invention accomplishes at least all of its stated objectives.

I claim:

1. A combined eye glass, contact lens and accessories case comprising:

a foldable panel member having an upper end, a lower end, opposite side edges, an inside surface, and an outside surface;

said panel member being foldable from a substantially flat condition to a folded condition wherein the panel member is folded upon itself;

said panel member including an upper panel portion, an intermediate panel portion, and a lower panel portion; said upper, intermediate and lower panel portions being substantially the same size;

said lower panel portion being foldable upwardly to contact and cover said intermediate panel portion;

said upper panel portion being foldable downwardly to contact and substantially cover said folded lower panel portion;

cooperable fastener means, for selectively maintaining said panel member in its folded condition, having a first half mounted on the inside surface of said upper panel portion and a second half mounted on the outer surface of said lower panel portion, said first and second halves being selectively cooperable;

a first rectangular partition member, of a size substantially equal to said intermediate panel portion having an upper and lower edge and opposing side edges, the lower edge and side edges of said first partition member being affixed to the inside surface of said intermediate panel portion of said panel member to substantially cover said intermediate panel portion so as to define an eye glass compartment between said first rectangular partition member and said intermediate panel portion, said eye glass compartment being open along the entire upper edge of said first rectangular partition member;

said first rectangular partition member having inner and outer surfaces;

a second rectangular partition member, of a size substantially equal to said first partition member, having an upper and lower edge and opposing side edges, the lower edge and side edges of said second partition member being secured to the lower edge and side edges of said first partition member, such that said second partition member substantially covers the first partition member, said second partition member being further secured intermediate its side edges, and parallel thereto to the outer surface of said first partition member to define first, second, and third parallel compartments having upper ends, said parallel compartments being open along the entire upper edge of said second partition member;

said upper edge of said second partition member having a stretchable elastic member affixed thereto so as to yieldably close the open upper ends of said first, second and third compartments by elastically biasing said upper edge of said second partition member against the outside surface of said first partition member.

2. A combined eye glass, contact lens and accessories case comprising:

a foldable panel member having an upper end, a lower end, opposite side edges, an inside surface, and an outside surface;

said panel member being foldable from a substantially flat condition to a folded condition wherein the panel member is folded upon itself;

said panel member including an upper panel portion and a lower panel portion, said upper panel portion being foldable downwardly and of a size so as to contact and substantially completely cover said lower panel portion;

means for selectively maintaining said panel member in its folded condition;

a first rectangular partition member, of a size substantially equal to said lower panel and having an upper and lower edge and opposing side edges, the lower edge and side edges of said first partition member being affixed to the inside surface of said lower panel portion of said panel member to substantially cover said lower panel so as to define an eye glass compartment between said first rectangular partition member and said lower panel portion, said eye glass compartment being open along the entire upper edge of said first rectangular partition member;

said first rectangular partition member having inner and outer surfaces;

a second rectangular partition member, having an upper and lower edge and opposing side edges, the lower edge of said second partition member being secured to the outer surface of said first rectangular partition member intermediate the upper and lower edges of said first partition member, the side edges of said second partition member being secured to the outer surface of said first partition member adjacent portions of the side edges of the first partition member, such that said second partition member substantially covers the outer surface of the first partition member from the lower edge of the second partition to the upper edge of the first partition member, to define a contact lens compartment between said second rectangular partition member and said first rectangular partition member, said contact lens case compartment being open along the entire upper edge of said second rectangular partition member; and a third rectangular partition member, having an upper and lower edge and opposing side edges, the lower edge of said third partition member being secured to the outside surface of said first partition member along the lower edge of said first partition member, the side edges of said third partition member being secured to the outside surface of said first partition member adjacent the side edges of said first partition member, such that said third partition member substantially covers the outer surface of the first partition member from the lower edge of the first partition member to the lower edge of the second partition member, said third partition member being further secured intermediate its side edges, and parallel thereto, to the outer surface of said first partition member to define first and second parallel compartments having upper ends, said parallel compartments being open along the entire upper edge of said third rectangular partition member.

* * * * *